US006698600B1

(12) United States Patent
Lee

(10) Patent No.: US 6,698,600 B1
(45) Date of Patent: Mar. 2, 2004

(54) SOCKET SUSPENSION RACK ASSEMBLY WITH QUICK RELEASE FUNCTION

(76) Inventor: Daniel Lee, No. 62, Jen-Mei Rd., 3 Lin, Jen-Hua Li, Tali City, Taichung Hsien (TW)

( * ) Notice: Subject to any disclaimer, the term of this patent is extended or adjusted under 35 U.S.C. 154(b) by 4 days.

(21) Appl. No.: 10/187,352

(22) Filed: Jul. 2, 2002

(51) Int. Cl.[7] ..... A47F 7/00
(52) U.S. Cl. ..... 211/70.6; 206/378
(58) Field of Search ..... 211/70.6; 206/378, 206/493, 806

(56) References Cited

U.S. PATENT DOCUMENTS

D443,160 S * 6/2001 Ernst ..... D6/553
6,415,933 B1 * 7/2002 Kao ..... 211/70.6
6,450,338 B1 * 9/2002 Chen ..... 211/70.6

* cited by examiner

*Primary Examiner*—Robert W. Gibson, Jr.
*Assistant Examiner*—Erica B Harris
(74) *Attorney, Agent, or Firm*—Charles E. Baxley

(57) ABSTRACT

A socket suspension rack assembly with a quick release function includes a support rack, and a slide rack slidably mounted on the support rack. The support rack has a periphery provided with multiple positioning studs and has a side wall formed with multiple receiving channels. The support rack has multiple flexible positioning plates each retractably mounted in the positioning stud and each having an extension movably mounted in the receiving channel. The slide rack has a side wall provided with multiple flexible press blocks each rested on the extension of the flexible positioning plate. Thus, the socket maybe readily mounted on and removed from the positioning stud of the support rack, thereby facilitating the user employing the socket.

14 Claims, 6 Drawing Sheets

SOCKET SUSPENSION RACK ASSEMBLY WITH QUICK RELEASE FUNCTION

BACKGROUND OF THE INVENTION

1. Field of the Invention

The present invention relates to a socket suspension rack assembly with a quick release funtion wherein the socket may be mounted on and removed from the square positioning stud of the support rack of the socket suspension rack assembly easily, quickly and conveniently, thereby facilitating the user employing the socket.

2. Description of the Related Art

A conventional socket suspension rack comprises a suspension bracket provided with multiple square positioning studs for retaining multiple sockets. However, each of the sockets is rigidly secured on each of the positioning studs by a positioning ball, so that each of the sockets cannot be removed from each of the positioning studs easily, quickly and conveniently, thereby causing inconvenience to the user when he needs to use the sockets.

SUMMARY OF THE INVENTION

The present invention has arisen to mitigate and/or obviate the disadvantage of the conventional socket suspension rack.

The primary objective of the present invention is to provide a socket suspension rack assembly with a quick release function, wherein the socket may be mounted on and removed from the square positioning stud of the support rack of the socket suspension rack assembly easily, quickly and conveniently, thereby facilitating the user employing the socket.

Another objective of the present invention is to provide a socket suspension rack assembly with a quick release function, wherein the socket may be retained on the square positioning stud of the support rack of the socket suspension rack assembly rigidly and stably.

In accordance with the present invention, there is provided a socket suspension rack assembly with a quick release function, comprising a support rack, and a slide rack slidably mounted on the support rack, wherein:

the support rack has a first side wall and a second side wall, the support rack has a periphery provided with multiple positioning studs, the second side wall of the support rack is formed with multiple receiving channels each aligning with one of the multiple positioning studs of the support rack, the support rack is provided with multiple flexible positioning plates each retractably mounted in one of the multiple positioning studs of the support rack and each having an extension movably mounted in one of the multiple receiving channels of the second side wall of the support rack; and the slide rack has a first side wall and a second side wall, the second side wall of the slide rack is formed with multiple flexible press blocks each having a first side rested on a first side of the extension of one of the multiple flexible positioning plates of the support rack.

Further benefits and advantages of the present invention will become apparent after a careful reading of the detailed description with appropriate reference to the accompanying drawings.

DETAILED DESCRIPTION OF THE INVENTION

Figure 1:
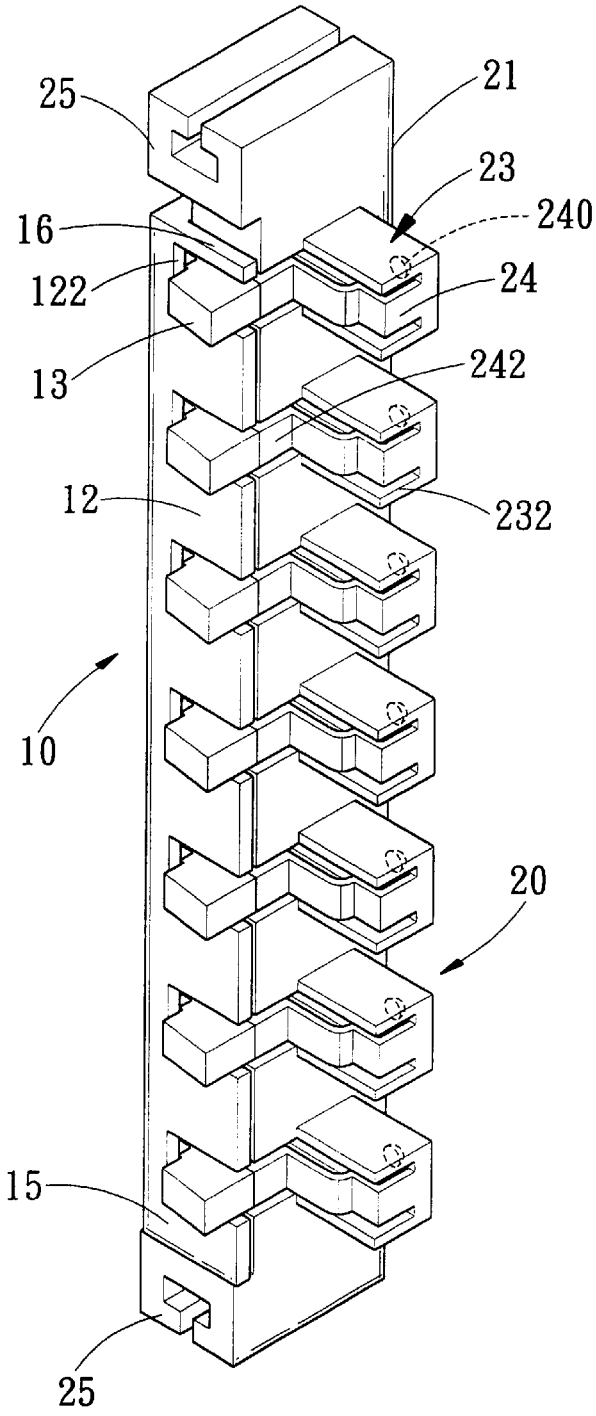
FIG. 1 is a perspective view of a socket suspension rack assembly with a quick release function in accordance with a preferred embodiment of the present invention.
Figure 2:
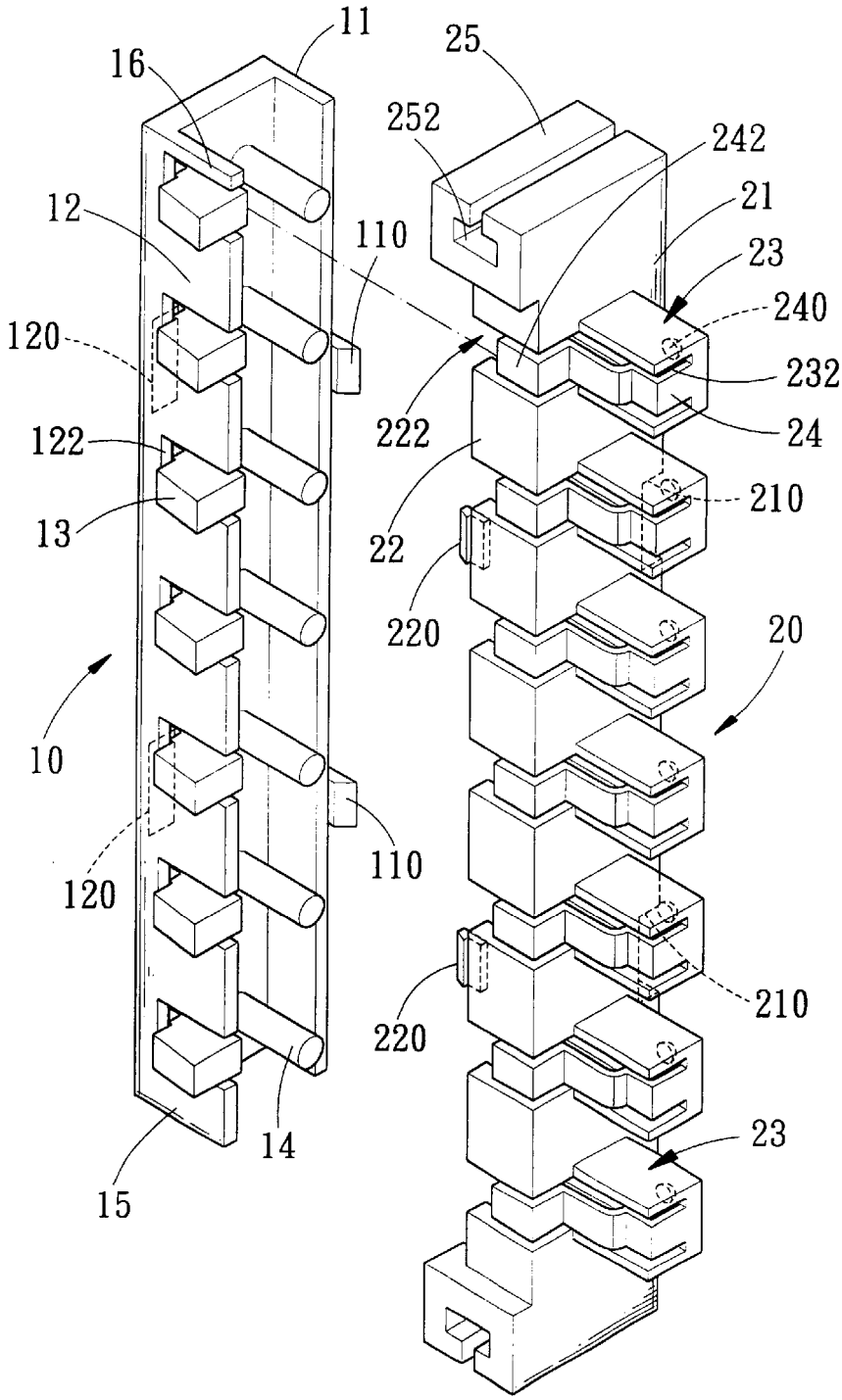
FIG. 2 is an exploded perspective view of the socket suspension rack assembly with a quick release function as shown in FIG. 1.
Figure 3:
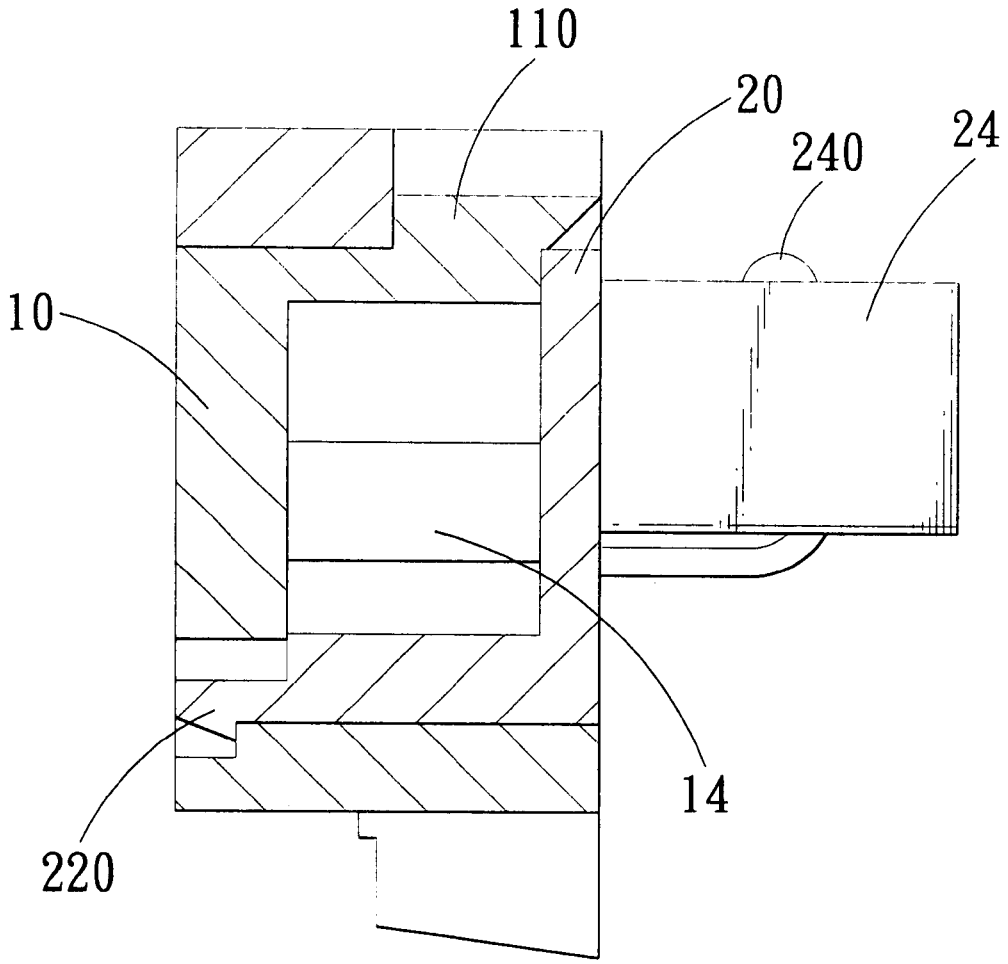
FIG. 3 is a top plan cross-sectional view of the socket suspension rack assembly with a quick release function as shown in FIG. 1.

Referring to the drawings and initially to FIGS. 1–3, a socket suspension rack assembly with a quick release function in accordance with a preferred embodiment of the present invention comprises a support rack 20, and a slide rack 10 slidably mounted on the support rack 20.

The support rack 20 is hollow and has a first side wall 21 formed with two elongated slide slots 210, and a second side wall 22 provided with two slide blocks 220. The slide rack 10 is hollow and has a first side wall 11 provided with two slide blocks 110 each slidably mounted in each of the two elongated slide slots 210 of the first side wall 21 of the support rack 20, and a second side wall 12 formed with two elongated slide slots 120, so that each of the two slide blocks 220 of the second side wall 22 of the support rack 20 is slidably mounted in each of the two elongated slide slots 120 of the second side wall 12 of the slide rack 10. Thus, the slide rack 10 is slidably mounted on the support rack 20.

Figure 4:
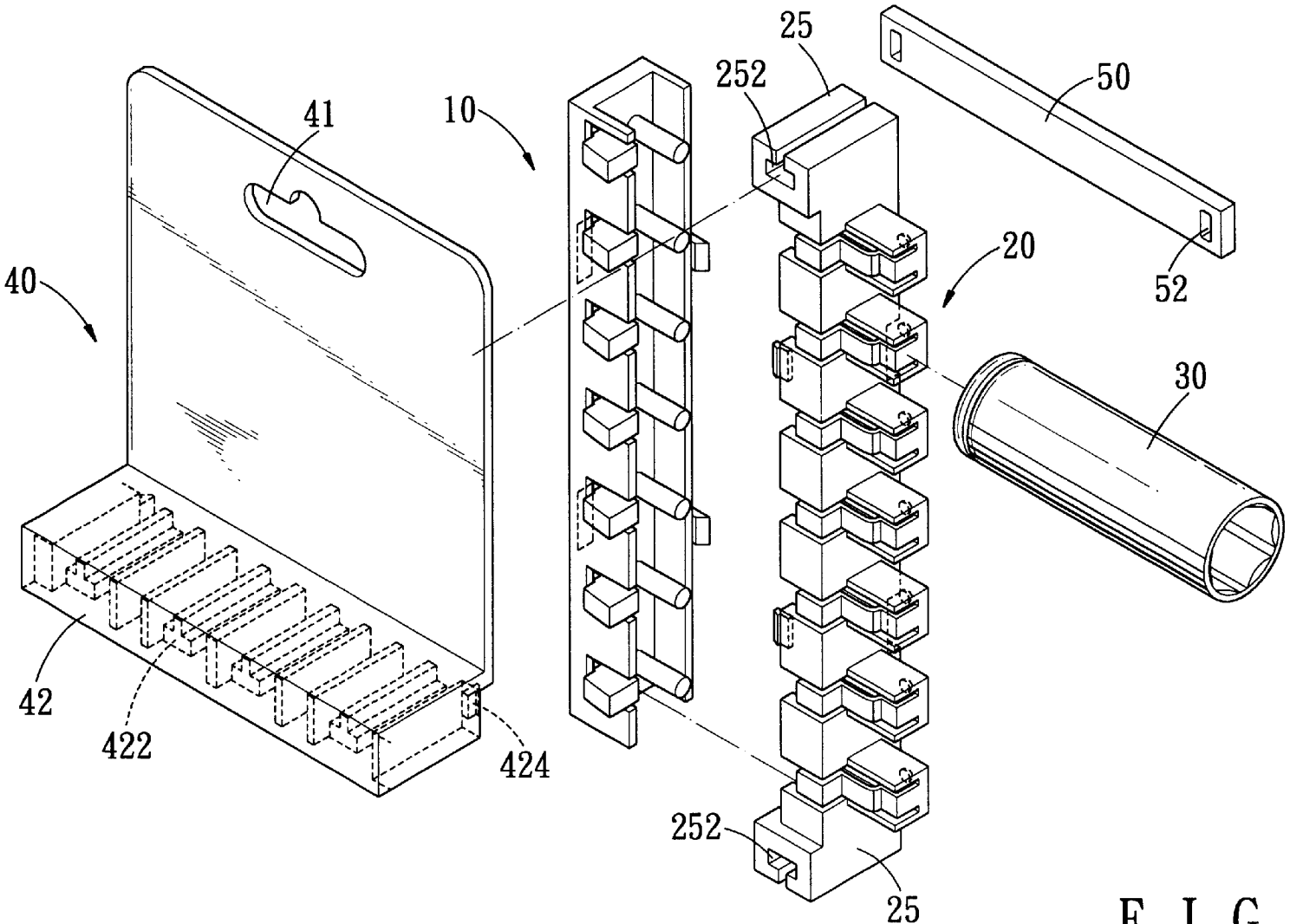
FIG. 4 is an exploded perspective view of a socket suspension rack assembly with a quick release function in accordance with another preferred embodiment of the present invention.

The support rack 20 has a periphery provided with multiple square positioning studs 23 for supporting a socket 30 (see FIG. 4). The second side wall 22 of the support rack 20 is formed with multiple receiving channels 222 each aligning with one of the multiple square positioning studs 23 of the support rack 20. Each of the multiple square positioning studs 23 of the support rack 20 is formed with a receiving chamber 232 communicating with one of the multiple receiving channels 222 of the second side wall 22 of the support rack 20. The support rack 20 is provided with multiple flexible positioning plates 24 each retractably mounted in the receiving chamber 232 of one of the multiple square positioning studs 23 of the support rack 20 and each having an extension 242 movably mounted in one of the multiple receiving channels 222 of the second side wall 22 of the support rack 20. Each of the multiple flexible positioning plates 24 is integrally formed on the respective square positioning stud 23 of the support rack 20. Each of the multiple flexible positioning plates 24 is provided with a positioning boss 240 for positioning the socket 30 on one of the multiple square positioning studs 23 of the support rack 20.

The support rack 20 has two distal ends each provided with a mounting head 25. The mounting head 25 of the support rack 20 is formed with an inverted T-shaped slot 252.

The second side wall 12 of the slide rack 10 is formed with multiple receiving spaces 122 and provided with multiple flexible press blocks 13 each movably mounted in one of the multiple receiving spaces 122. Each of the multiple flexible press blocks 13 is integrally formed on the slide rack 10. Each of the multiple flexible press blocks 13 of the slide rack 10 has a first side rested on a first side of the extension 242 of one of the multiple flexible positioning plates 24 of the support rack 20, and a second side protruded outward from the receiving space 122.

The slide rack 10 has an inside provided with multiple positioning rods 14 each located between any two adjacent press blocks 13 of the multiple flexible press blocks 13 of the slide rack 10. Each of multiple positioning rods 14 of the slide rack 10 may be axially moved with the slide rack 10 to abut a second side of the extension 242 of one of the multiple flexible positioning plates 24 of the support rack 20.

In operation, the slide rack 10 may be axially moved on the support rack 20 to a first position as shown in FIG. 1 where each of the multiple flexible press blocks 13 of the slide rack 10 is aligned with the extension 242 of the respective flexible positioning plate 24 of the support rack 20.

At this time, the first side of each of the multiple flexible press blocks 13 of the slide rack 10 is rested on the first side of the extension 242 of the respective flexible positioning plate 24 of the support rack 20, while each of the multiple positioning rods 14 located between any two adjacent press blocks 13 of the slide rack 10 is detached from the second side of the extension 242 of the respective flexible positioning plate 24 of the support rack 20, so that the second side of each of the multiple flexible press blocks 13 of the slide rack 10 may be pressed inward by the user to press the extension 242 of the respective flexible positioning plate 24 of the support rack 20, so as to retract the flexible positioning plate 24 into the square positioning stud 23 of the support rack 20, thereby detaching and releasing the socket 30 (see FIG. 4) from the positioning boss 240 of the flexible positioning plate 24, so that the socket 30 may be removed from the square positioning stud 23 of the support rack 20 easily and conveniently, thereby facilitating the user employing the socket 30.

At the first position, as shown in FIG. 1, the lower end 15 of the slide rack 10 is stopped by the mounting head 25 of the lower distal end of the support rack 20, thereby preventing from a further movement of the slide rack 10.

Alternatively, the slide rack 10 may be axially moved on the support rack 20 to a second position (not shown) where each of the multiple flexible press blocks 13 of the slide rack 10 is detached from the extension 242 of the respective flexible positioning plate 24 of the support rack 20.

At this time, the second side wall 12 of the slide rack 10 is rested on the first side of the extension 242 of the respective flexible positioning plate 24 of the support rack 20, while each of the multiple positioning rods 14 is rested on the second side of the extension 242 of the respective flexible positioning plate 24 of the support rack 20, so that the extension 242 of the respective flexible positioning plate 24 of the support rack 20 cannot be pressed, thereby preventing the flexible positioning plate 24 from being retracted into the square positioning stud 23 of the support rack 20, so that the socket 30 (see FIG. 4) is retained by the positioning boss 240 of the flexible positioning plate 24, an cannot be removed from the square positioning stud 23 of the support rack 20, thereby retaining the socket 30 rigidly and stably.

At the second position, the upper end 16 of the slide rack 10 is stopped by the mounting head 25 of the upper distal end of the support rack 20, thereby preventing from a further movement of the slide rack 10.

Figure 5:
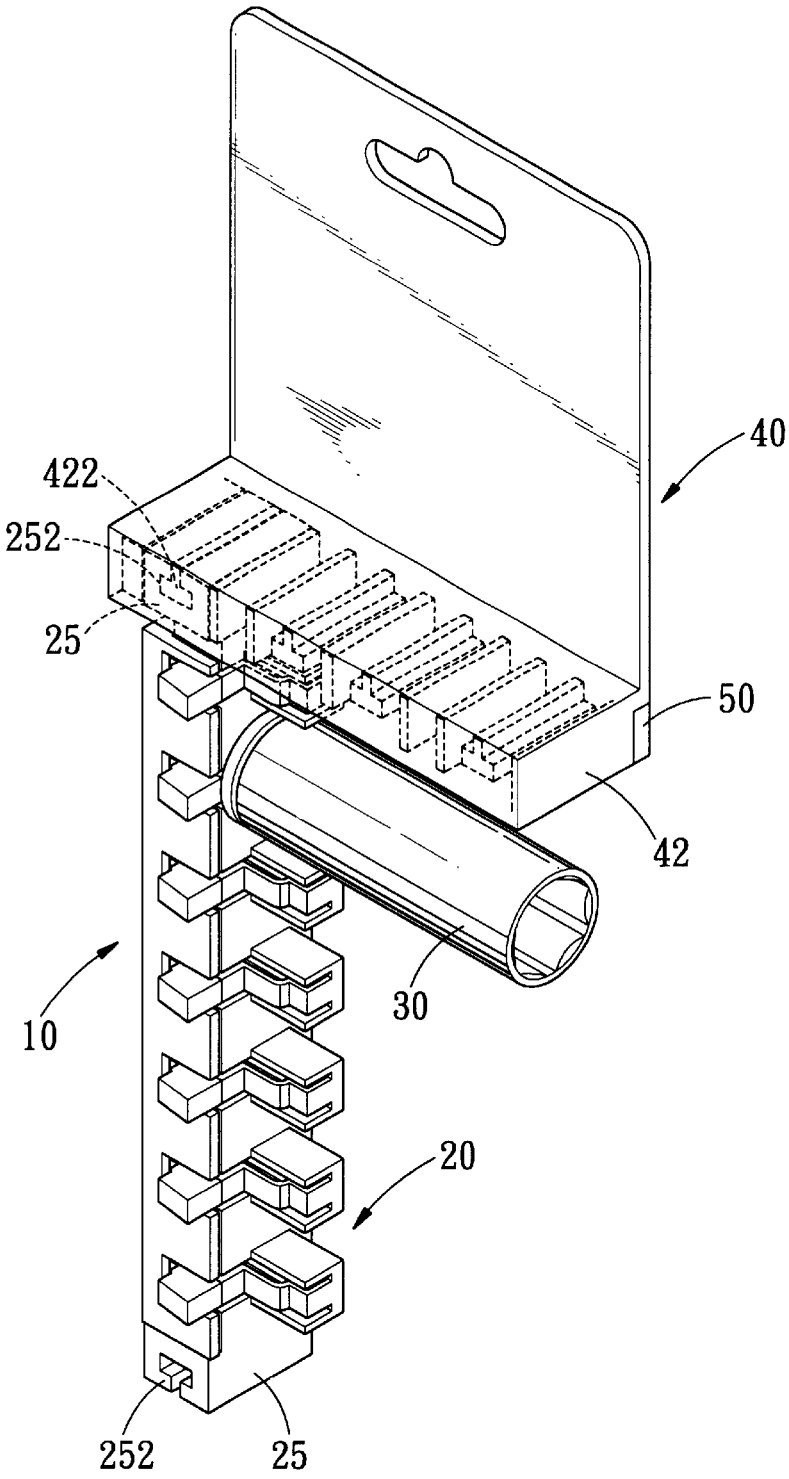
FIG. 5 is a perspective assembly view of the socket suspension rack assembly with a quick release function as shown in FIG. 4.

Referring to FIGS. 4 and 5, the socket suspension rack assembly with a quick release function in accordance with the preferred embodiment of the present invention further comprises a suspension bracket 40 having an upper portion formed with a hole 41 for hanging the suspension bracket 40 on a wall. The suspension bracket 40 has a lower portion provided with a hollow support base 42. The support base 42 of the suspension bracket 40 is provided with multiple inverted T-shaped insertion blocks 422. Thus, after the slide rack 10 is combined with the support rack 20, the support rack 20. may be mounted on the support base 42 of the suspension bracket 40, whereby one of the multiple inverted T-shaped insertion blocks 422 of the support base 42 of the suspension bracket 40 may be inserted into the inverted T-shaped slot 252 of the mounting head 25 of the support rack 20, so that the support rack 20 may be mounted on the support base 42 of the suspension bracket 40.

The socket suspension rack assembly further comprises a retaining bar 50 secured on the support base 42 of the suspension bracket 40, for retaining the support rack 20 on the support base 42 of the suspension bracket 40. The retaining bar 50 has two ends each formed with a positioning hole 52. The support base 42 of the suspension bracket 40 has two ends each provided with a positioning block 424 inserted into the positioning hole 52 of the retaining bar 50, so that the retaining bar 50 may be secured on the support base 42 of the suspension bracket 40.

Figure 6:
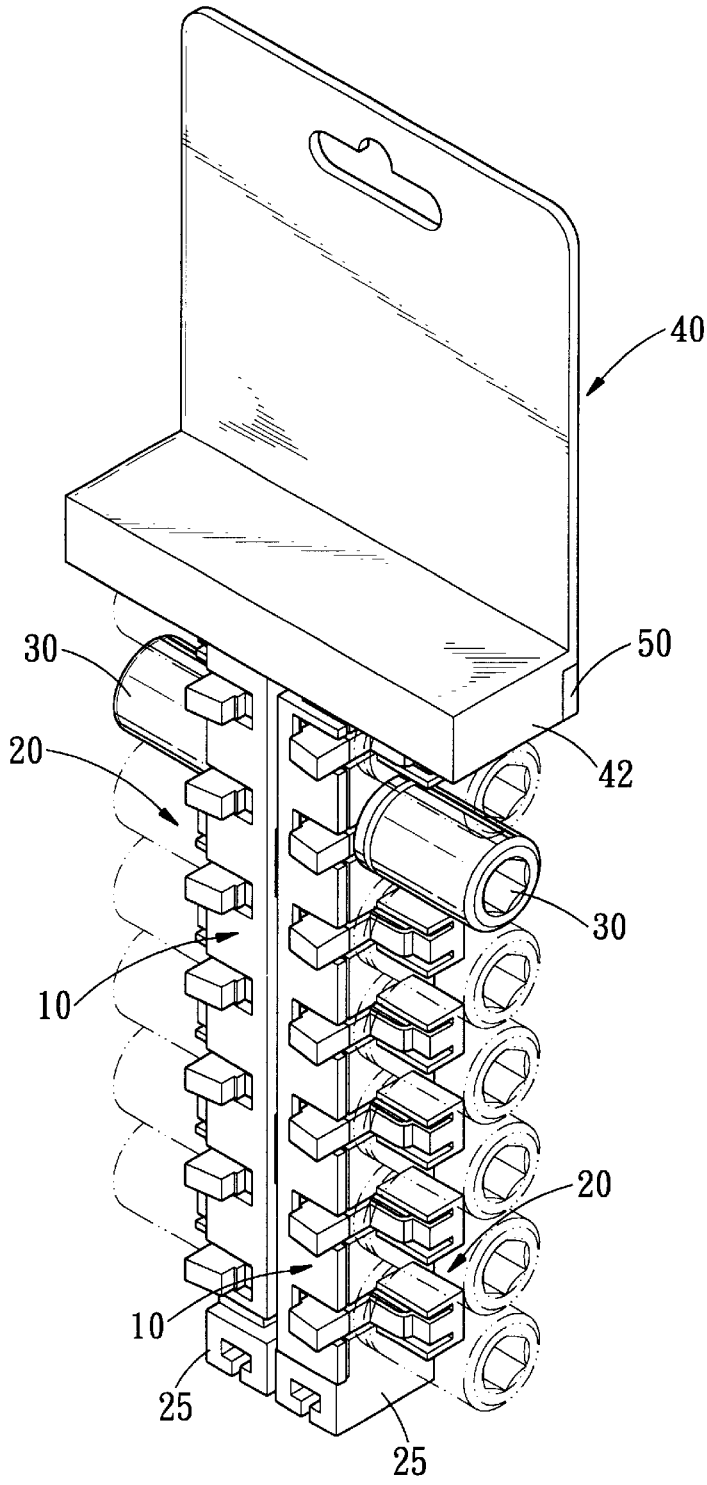
FIG. 6 is a perspective assembly view of a socket suspension rack assembly with a quick release function in accordance with another preferred embodiment of the present invention.

Referring to FIG. 6, in accordance with another preferred embodiment of the present invention, two support racks 20 may be secured and suspended on the support base 42 of the suspension bracket 40.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A socket suspension rack assembly with a quick release function, comprising a support rack, and a slide rack slidably mounted on the support rack, wherein:

the support rack has a first side wall and a second side wall, the support rack has a periphery provided with multiple positioning studs, the second side wall of the support rack is formed with multiple receiving channels each aligning with one of the multiple positioning studs of the support rack, the support rack is provided with multiple flexible positioning plates each retractably mounted in one of the multiple positioning studs of the support rack and each having an extension movably mounted in one of the multiple receiving channels of the second side wall of the support rack; and the slide rack has a first side wall and a second side wall, the second side wall of the slide rack is formed with multiple flexible press blocks each having a first side rested on a first side of the extension of one of the multiple flexible positioning plates of the support rack.

2. The socket suspension rack assembly with a quick release function in accordance with claim 1, wherein the first side wall of the support rack is formed with two elongated slide slots, and the first side wall of the slide rack is provided with two slide blocks each slidably mounted in each of the two elongated slide slots of the first side wall of the support rack.

3. The socket suspension rack assembly with a quick release function in accordance with claim 1, wherein the second side wall of the slide rack is formed with two elongated slide slots, and the second side wall of the support rack is provided with two slide blocks each slidably mounted in each of the two elongated slide slots of the second side wall of the slide rack.

4. The socket suspension rack assembly with a quick release function in accordance with claim 1, wherein each of the multiple positioning studs of the support rack is formed with a receiving chamber communicating with one of the multiple receiving channels of the second side wall of the support rack, and each of the multiple flexible positioning plates is retractably mounted in the receiving chamber of one of the multiple positioning studs of the support rack.

5. The socket suspension rack assembly with a quick release function in accordance with claim 1, wherein each of the multiple flexible positioning plates is integrally formed on the respective positioning stud of the support rack.

6. The socket suspension rack assembly with a quick release function in accordance with claim 1, wherein each of the multiple flexible positioning plates is provided with a positioning boss for positioning a socket on one of the multiple positioning studs of the support rack.

7. The socket suspension rack assembly with a quick release function in accordance with claim 1, wherein the second side wall of the slide rack is formed with multiple receiving spaces, and each of the multiple flexible press blocks is movably mounted in one of the multiple receiving spaces.

8. The socket suspension rack assembly with a quick release function in accordance with claim 7, wherein each of the multiple flexible press blocks has a second side protruded outward from the receiving space.

9. The socket suspension rack assembly with a quick release function in accordance with claim 1, wherein each of the multiple flexible press blocks is integrally formed on the slide rack.

10. The socket suspension rack assembly with a quick release function in accordance with claim 1, wherein the slide rack has an inside provided with multiple positioning rods each located between any two adjacent press blocks of the multiple flexible press blocks of the slide rack, and each of multiple positioning rods of the slide rack may be axially moved with the slide rack to abut a second side of the extension of one of the multiple flexible positioning plates of the support rack.

11. The socket suspension rack assembly with a quick release function in accordance with claim 1, wherein the support rack has two distal ends each provided with a mounting head for stopping one end of the slide rack, thereby preventing from a further movement of the slide rack.

12. The socket suspension rack assembly with a quick release function in accordance with claim 11, wherein the mounting head of the support rack is formed with an inverted T-shaped slot, and the socket suspension rack assembly further comprises a suspension bracket provided with a hollow support base which is provided with multiple inverted T-shaped insertion blocks, and one of the multiple inverted T-shaped insertion blocks of the support base of the suspension bracket may be inserted into the inverted T-shaped slot of the mounting head of the support rack, so that the support rack may be mounted on the support base of the suspension bracket.

13. The socket suspension rack assembly with a quick release function in accordance with claim 12, further comprising a retaining bar secured on the support base of the suspension bracket, for retaining the support rack on the support base of the suspension bracket.

14. The socket suspension rack assembly with a quick release function in accordance with claim 13, wherein the retaining bar has two ends each formed with a positioning hole, and the support base of the suspension bracket has two ends each provided with a positioning block inserted into the positioning hole of the retaining bar, so that the retaining bar may be secured on the support base of the suspension bracket.

* * * * *